United States Patent [19]

Gaia

[11] 4,058,784

[45] Nov. 15, 1977

[54] INDICATOR-EQUIPPED, DUAL-ELEMENT FUSE

[75] Inventor: Aldino J. Gaia, St. Louis, Mo.

[73] Assignee: McGraw-Edison Company, Elgin, Ill.

[21] Appl. No.: 660,770

[22] Filed: Feb. 23, 1976

[51] Int. Cl.[2] ..... H01H 85/30

[52] U.S. Cl. ..... 337/164; 337/206; 337/292

[58] Field of Search ..... 337/163–165, 337/178, 206, 241, 244, 267, 292; 340/250

[56] References Cited

U.S. PATENT DOCUMENTS

| | | | |
|---|---|---|---|
| 2,400,491 | 5/1946 | Duerkob | 337/164 |
| 2,543,245 | 2/1951 | Laing | 337/241 |
| 2,665,349 | 1/1954 | Sander | 337/164 |
| 3,593,249 | 7/1971 | Sedgwick | 337/244 |
| 3,678,430 | 7/1972 | Gaia | 337/244 |

FOREIGN PATENT DOCUMENTS

| | | | |
|---|---|---|---|
| 542,637 | 5/1956 | Belgium | 337/292 |

*Primary Examiner*—William H. Beha, Jr.
*Attorney, Agent, or Firm*—Jon Carl Gealow; Thomas E. McDonald; Ronald J. LaPorte

[57] ABSTRACT

A circuit-interrupting device has a stationary current-conducting member, a movable current-conducting member, a connector which accommodates the adjacent ends of the current-conducting members and which normally holds a mass of heat-softenable alloy in engagement with those adjacent ends, an indicator which is connected to the movable current-conducting member and a spring which can simultaneously move the movable current-conducting member, and the indicator to moved positions whenever the circuit-interrupting device opens the circuit. The adjacent ends of the current-conducting members extend into the connector a distance less than one-half of the minimum distance through which the spring will move the indicator.

15 Claims, 5 Drawing Figures

INDICATOR-EQUIPPED, DUAL-ELEMENT FUSE

BACKGROUND OF THE INVENTION

A dual element electric fuse has at least one fusible element which is intended to respond to a heavy overcurrent or short circuit to open the circuit and has a mass of heat-softenable alloy which normally connects that fusible element to another current-conducting element. The mass of heat-softenable alloy usually constitutes, or is in contact with, a heat-absorbing element so the softening of the mass of heat-softenable alloy is delayed to provide a desired, predetermined, time-delay before the electric fuse responds to a relatively-low but potentially-harmful overcurrent to effect opening of the circuit. A dual element electric fuse which is equipped with an indicator includes the hereinbefore-recited elements and mass of heat-softenable alloy and, in addition, includes a normally-retracted indicator which is moved to extended position by a spring whenever the dual element electric fuse opens the circuit.

SUMMARY OF THE INVENTION

A circuit-interrupting device has a stationary current-conducting member, a movable current-conducting member which has an initial position and a moved position and which has one end thereof adjacent one end of the stationary current-conducting member whenever it is in its initial position, a connector which accommodates the adjacent ends of the current-conducting members and which normally holds a mass of heat-softenable alloy in engagement with those adjacent ends, an indicator which is connected to the movable current-conducting member and which has an initial position wherein it is retracted and a moved position wherein it is extended, and a spring which can simultaneously move the movable current-conducting member and the indicator from their initial positions to their moved positions whenever the circuit-interrupting device opens the circuit. In the event a very heavy overcurrent or short circuit develops, one or both of the current-conducting members will fuse, and then the spring will simultaneously move the indicator and any unfused portion of the movable current-conducting member to their moved positions. In the event a low, but potentially-harmful, overcurrent develops, the mass of heat-softenable alloy will soften to permit relative movement between the connector and one or both of the current-conducting members; and then the spring will simultaneously move the movable current-conducting member and the indicator to their moved positions. In each event, the circuit will be opened and the indicator will indicate that the circuit has been opened. It is, therefore, an object of the present invention to provide a circuit-interrupting device which has a stationary current-conducting member, a movable current-conducting member which has an initial position and a moved position and which has one end thereof adjacent one end of the stationary current-conducting member whenever it is in its initial position, a connector which accommodates the adjacent ends of the current-conducting member and which normally holds a mass of heat-softenable alloy in engagement with those adjacent ends, an indicator which is connected to the movable current-conducting member and which has an initial position wherein it is retracted and a moved position wherein it is extended, and a spring which can simultaneously move the movable current-conducting member and the indicator from their initial positions to their moved positions whenever the circuit-interrupting device opens the circuit.

The adjacent ends of the current-conducting members extend into the connector, but each of those adjacent ends extends into that connector a distance less than one-half of the minimum distance through which the spring will move the indicator whenever the circuit-interrupting device opens the circuit. As a result, whether the connector moves with the movable current-conducting member as that current-conducting member and the indicator are simultaneously moved by the spring, whether the connector and the stationary current-conducting member remain immobile as the movable current-conducting member and the indicator are simultaneously moved by the spring, or whether the connector moves relative to both current-conducting members, a finite gap always will be formed between the connector and one or more of the current-conducting members as the circuit-interrupting device opens the circuit. In the event that gap did not happen to be large enough to effect immediate opening of the circuit, any arc that might form between the connector and one or the other of the current-conducting members would provide heat which would additionally soften the mass of heat-softenable alloy, and would thereby permit the connector to move further away from either or both of those current-conducting members to effect prompt extinguishing of that arc. It is, therefore, an object of the present invention to provide a circuit-interrupting device which has a stationary current-conducting member with one end thereof extending into a connector, a movable current-conducting member which has one end thereof extending into that connector, and a spring which will, whenever the circuit-interrupting device opens the circuit, move that connector a distance greater than twice the distance which either of those ends extends into that connector.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

DETAILED DESCRIPTION OF THE PREFERRED EMBODIMENT

Figure 1:
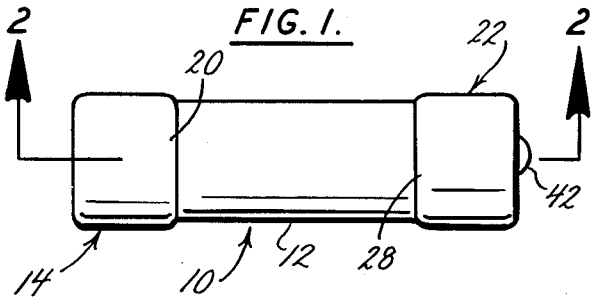
FIG. 1 is a side elevational view of one preferred embodiment of electric fuse which is made in accordance with the principles and teachings of the present invention.

Referring to the drawing in detail, the numeral 10 generally denotes one preferred embodiment of indicator-equipped, dual element, electric fuse provided by the present invention. The numeral 12 denotes the casing of that electric fuse; and that casing is tubular in form and is made from insulating material such as fiber, paper, glass melamine, or the like. The numeral 14 generally denotes a ferrule-type metal terminal which is dimensioned to telescope over one end of the casing 12. That terminal has a recessed end wall 16 with an opening 18 adjacent the center thereof. After that terminal has been telescoped over that one end of the casing 12, the rim 20 of that terminal is crimped or otherwise forced into holding engagement with that casing.

The numeral 22 generally denotes a second ferrule-like metal terminal which is dimensioned to telescope over the other end of the casing 12. That terminal has a recessed end wall 24 with a generally tubular passage 26 at the center thereof. After that terminal has been telescoped over the other end of the casing 12, the rim 28 of that terminal is crimped or otherwise forced into holding engagement with that casing.

Figure 3:
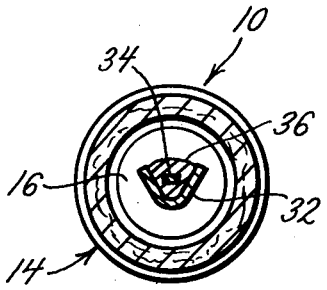
FIG. 3 is another sectional view, on the scale of FIG. 2, through the electric fuse of FIG. 1, and it is taken along the plane indicated by the line 3—3 in FIG. 2.
Figure 4:
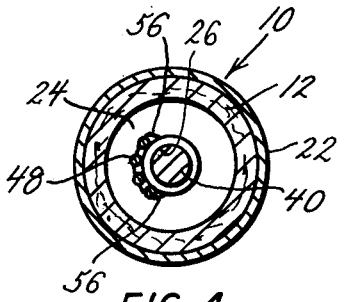
FIG. 4 is a further sectional view, on the scale of FIG. 2, through the electric fuse of FIG. 1, and it is taken along the plane indicated by the line 4—4 in FIG. 2.

The numeral 30 denotes a current-conducting member which can be a wire or a punched strip. The left-hand end of that member extends through the opening 18 in the recessed end wall 16 of the terminal 14 and then is bent over into the recess which is defined by that end wall. The current-conducting member 30 extends generally axially of the casing 12; and the right-hand end thereof extends a short distance into the left-hand end of a connector 32. That connector is trough-shaped; and it is generally aligned with the current-conducting member 30. That connector is generally V-shaped in end view, as shown by FIG. 3; and the internal dimensions of that connector are sufficiently large to enable that connector to freely accommodate the right-hand end of the current-conducting member 30. The numeral 34 denotes a current-conducting member which extends generally axially of the casing 12 and which has the left-hand end thereof extending a short distance into the right-hand end of the connector 32. The numeral 36 denotes a mass of heat-softenable alloy which is disposed within the connector 32 and which normally holds that connector in mechanical engagement and in electrical connection with the adjacent ends of the current-conducting members 30 and 34.

Figure 5:
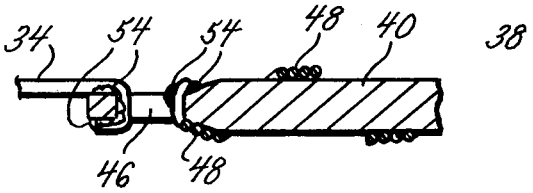
FIG. 5 is yet another sectional view, on an even larger scale, through the electric fuse of FIG. 1, and it is taken along the plane indicated by the line 5—5 in FIG. 2.

The numeral 38 generally denotes an indicator which has an elongated shank 40 that is dimensioned to move freely within the passage 26 of the terminal 22. A semi-spherical head 42 on the right-hand end of the indicator 38 confines one end of a helical compression spring 44; and the other end of that helical compression spring is held by the recess in the recessed end wall 24 of the terminal 22. The left-hand end of the shank 40 of the indicator 38 is planished to have a D-like configuration; and an opening 46 is formed in that planished end. The right-hand end of the current-conducting member 34 is passed downwardly through the opening 46 and then is bent into general parallelism with the rest of that current-conducting member, as shown by FIG. 5. A plural-strand flexible conductor 48 has one end thereof passed through the opening 46 in the planished end of the shank 40 of the indicator 38. High temperature solder 54 is used to provide a mechanical engagement and electrical bond between the planished end of the shank 40 of the indicator 38 and the right-hand end of current-conducting member 34 and the left-hand end of plural-strand flexible conductor 48. The right-hand end of that plural-strand flexible conductor is formed into a ring and is telescoped over the outer surface of the passage 26 of the terminal 22. High temperature solder 56 is used to provide mechanical engagement and electrical connection between that end of that plural-strand flexible conductor and that terminal. High temperature solder 50 is used to provide a mechanical engagement and electrical connection between the left-hand end of the current-conducting member 30 and the terminal 14.

One preferred embodiment of indicator-equipped, dual element, electric fuse provided by the present invention has a voltage rating of one hundred and twenty-five volts and an ampere rating from one and one-quarter amperes through ten amperes. If desired, that electric fuse could be made to have an even lower ampere rating or could be made to have an even higher ampere rating. The casing 12 has an outer diameter of about three eighths of an inch and is one and one-half inches long. The connector 32 is one-half of an inch long; and the right-hand end of the current-conducting member 30 extends into the left-hand end of that connector a distance of one hundred and twenty-five thousandths of an inch, while the left-hand end of the current-conducting member 34 extends into the right-hand end of that connector an equal distance. The current-conducting member 30 is made from No. 30 Nichrome wire and the current-conducting member 34 is made from No. 30 Advance wire when the electric fuse has an ampere rating of one and one-quarter amperes. When that electric fuse has an ampere rating of ten amperes, the current-conducting member 30 is made from No. 26 wire of 30-alloy whereas the current-conducting member 34 is made from No. 24 copper wire. The length of the current-conducting member 30 between the inner face of the terminal 16 and the right-hand end of that current-conducting member is four-tenths of an inch. The length of the current-conducting member 34 between the left-hand edge of the planished end of the shank 40 of the indicator 38 and the left-hand end of that current-conducting member is twenty-two hundredths of an inch. The current-conducting members can be made of Nichrome wire, Advance wire, copper wire, or copper-alloy wire. Further, if desired, those current-conducting members could be made as punched strips.

Figure 2:
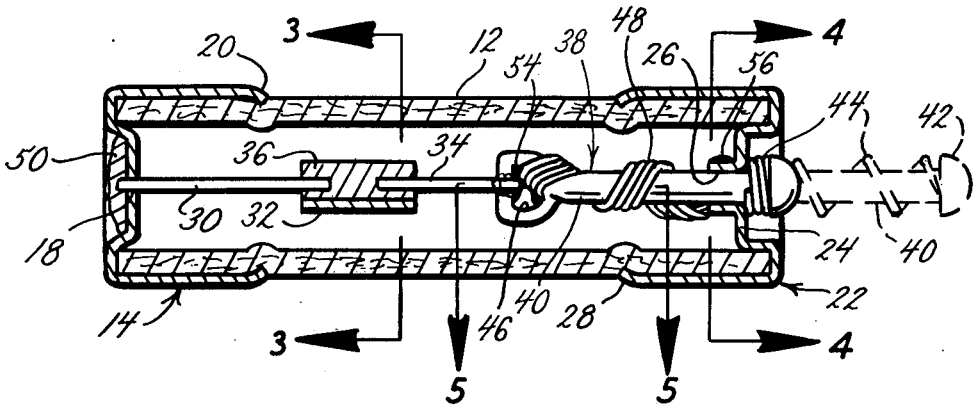
FIG. 2 is a sectional view, on a larger scale, through the electric fuse of FIG. 1, and it is taken along the plane indicated by the line 2—2 in FIG. 1.

The maximum linear transverse dimension of the connector 32 must be smaller than the inner diameter of the casing 12. Actually, as shown by FIGS. 2 and 3, the maximum linear transverse dimension of that connector is substantially smaller than the inner diameter of that casing; and hence that connector can move transversely of, as well as axially of, that casing when the mass 36 of heat softenable alloy softens. The length of the connector 32 is equal to the sum of the embedded ends of the current-conducting members 30 and 34 plus a short gap between those embedded ends.

A two-strand flexible conductor 48 of No. 33 copper is used when the electric fuse 10 is made in ampere ratings of one and one-quarter, one and four-tenths, one and one-half, one and six-tenths, or one and eight-tenths amperes. A four-strand flexible conductor 48 of No. 33 copper is used when the electric fuse 10 is made in ampere ratings of two, two and one-quarter, two and one-half, two and eight-tenths, three, three and two-tenths, three and one-half, four, or four and one-half amperes. A four-strand flexible conductor 48 of No. 31 copper is used when the electric fuse 10 is made in ampere ratings of five, five and six-tenths, six and one-quarter, seven, eight, nine, and ten amperes.

The current-conducting member 30 preferably is the current-conducting member which will fuse when the electric fuse 10 is subjected to a very heavy overcurrent or short circuit. However, if desired, the current-conducting member 34 could be made so it was the current-conducting member which would fuse in response to a very heavy overcurrent or short circuit. Alternatively, the current-conducting members 30 and 34 could be made so both of them would respond to very heavy overcurrents or short circuits to fuse.

Whenever current flows through the electric fuse 10, all current-conducting portions of that electric fuse will generate heat. However, because the cross sections of the connector 32, of the mass 36 of heat softenable alloy, and of the plural-strand flexible conductor 48 are much larger than the cross section of either of the current-conducting members 30 and 34, the principal amounts of heat which are generated as current flows through the electric fuse 10 will be generated by the current-conducting members 30 and 34.

As long as the current flowing through the electric fuse 10 is below the ampere rating of that electric fuse, the current-conducting members 30 and 34 will remain intact and the mass 36 of heat-softenable alloy will hold the connector 32 in mechanical engagement and in electrically-conducting relation with both of those current-conducting members. In the event a relatively-low, potentially-harmful overcurrent develops, the current-conducting members 30 and 34 will generate higher-than-normal amounts of heat; and the mass 36 of heat-softenable alloy will respond to that heat to soften. Thereupon, any one of several actions could occur. For example, as will happen most often, the portion of the mass 36 of heat-softenable alloy adjacent the left-hand end of the connector 32 could soften before the portion of that mass of heat-softenable alloy which is adjacent the right-hand end of that connector softens; and, in that event, the spring 44 would simultaneously move the indicator 38, the current-conducting member 34 and the connector 32 away from the right-hand end of the current-conducting member 30 to open the circuit. Alternatively, the portion of the mass 36 of heat-softenable alloy adjacent the right-hand end of the connector 32 could soften before the portion of the mass of heat-softenable alloy which is adjacent the left-hand end of that connector softened; and, in that event, the spring 44 would simultaneously move the indicator 38 and the current-conducting member 34 away from the connector 32 to open the circuit. A further possibility is that both ends of the mass 36 of heat-softenable alloy would soften sufficiently to permit the connector 32 to free the confronting ends of both of the current-conducting members 30 and 34; and, in that event, the spring 44 would simultaneously move the indicator 38 and the current-conducting member 34 away from the connector 32, and all or part of that connector would also fall away from the current-conducting member 30 and toward the inner surface of the casing 12.

In the first of these events, the movement of the connector 32 away from the current-conducting member 30 should provide a gap which is long enough to effect immediate opening of the circuit, because the minimum distance through which the spring 44 will move the indicator 38 is two hundred and eighty-one thousandths of an inch. In the second and third of these events, the movement of the current-conducting member 34 away from the connector 32 should provide a gap which is long enough to effect immediate opening of the circuit, because the minimum distance, due to manufacturing tolerances, through which the spring 44 will move the indicator 38 is two hundred and eighty-one thousandths of an inch. The maximum distance, due to manufacturing tolerances, through which the spring 44 will move the indicator 38 is four hundred and six thousandths of an inch.

The indicator 38 could be used as the movable contact of a switch. Where that was done, a stationary switch contact would be mounted in the path of the head 42 of the indicator 38, and that head would move into engagement with that stationary contact when the electric fuse 10 opened the circuit. At that time, current would flow from the terminal 22 via the plural-strand flexible conductor 48 to the shank 40 of the indicator 38, and then via the head 42 to the stationary contact. Alternatively, the indicator 38 could be used to move a bail, a plunger, or some other actuator of a switch. If a stationary switch contact, a bail, a plunger or some other actuator of a switch were to keep the indicator 38 from moving to its fully-extended position, an arc might develop between the connector 32 and one or the other or both of the current-conducting members 30 and 34. In that event, the heat which was generated by that arc would promptly raise the temperature of the mass 36 of heat-softenable alloy to the point where the connector 32 could fall away from those current-conducting members and thereby effect prompt extinguishing of that arc.

In the event a heavy overcurrent or a short circuit develops, the current-conducting member 30 will promptly fuse. If the heavy overcurrent or short circuit is of sufficient magnitude, the current-conducting member 34 also may fuse. In the first event, the spring 44 will move the connector 32 away from the fusing current-conducting member 30. In the latter event, the spring 44 will move the planished end of the indicator 38 away from the fusing current-conducting member 34. In each event, the mechanically-enlarged arc gap will assure immediate extinguishing of the arc which forms as the current-conducting member fuses.

The left-hand end of the current-conducting member 30 is firmly and solidly held by solder 50 and the terminal 14; and hence that current-conducting member acts, in cantilever fashion, to support the left-hand end of the connector 32. The shank 40 of the indicator 38 is closely confined and guided by the passage 26 of the terminal 22; and the right-hand end of the current-conducting member 34 is firmly and solidly secured to that shank by the solder 54. As a result, the indicator 38 and the current-conducting member 34 act, in cantilever fashion to support the right-hand end of the connector 32.

It is important to note that the electric fuse 10 indicates the opening of the circuit whether the current-conducting member 30 or the current-conducting member 34 fuses. This is desirable; because it frees the manufacturer of that electric fuse from the need of selecting materials and dimensions for those current-conducting members which would make certain that the current-conducting member 34 would not fuse unless and until the magnitude of the heavy overcurrent or short circuit was great enough to ensure the fusing of the current-conducting member 30. By making certain that the indicator 38 is freed for movement to its extended position regardless of which of the current-conducting members 30 and 34 responds to a heavy overcurrent or short circuit to fuse, the manufacturer of the electric fuse 10 can make either of those current-conducting members so it is the primary fusing member and can make the other of those current-conducting members so it is the member which will fuse only in the event the overcurrent or short circuit is heavy enough to cause both current-conducting members to fuse. Further, because the indicator 38 will move to its extended position whether either or both of the current-conducting members 30 and 34 fuse, those current-conducting members could be made so they would tend to fuse simultaneously.

It should also be noted that the spring 44 performs the dual functions of providing a mechanically-enlarged gap and of moving the indicator 38 to its extended position. Not only does this reduce the cost of the components of, and the cost of assembling, the electric fuse 10, but it also enables the indicator-equipped, dual-element, electric fuse of the present invention to be mounted and operated in a casing which has an outer diameter of just about three-eighths of an inch and has a length of just one and one-half inches.

Whereas the drawing and accompanying description have shown and described one preferred embodiment of the present invention, it should be apparent to those skilled in the art that various changes may be made in the form of the invention without affecting the scope thereof.

What I claim is:

1. An indicator-equipped, dual-element, electric fuse which comprises a casing, a current-conducting member disposed within said casing, a second current-conduct member disposed within said casing, heat-softenable alloy which normally maintains said current-conducting members in electrically-conducting relation, an indicator which is disposable in an initial, retracted position or in a moved, extended position, said indicator being held in said initial, retracted position as long as both of said current-conducting members remain intact and said heat-softenable alloy maintains said current-conducting members in electrically-conducting relation, and a spring which will move one of said current-conducting members away from said heat-softenable alloy and will simultaneously move said indicator to said moved, extended position and will thereby simultaneously provide relative movement between said current-conducting members and also will provide relative movement between said one of said current-conducting members and said heat-softenable alloy whenever said heat-softenable alloy softens sufficiently to free said one of said current-conducting members, said casing defining an open area into which said spring can bodily move said heat-softenable alloy, said spring simultaneously moving said one of said current-conducting members and said heat-softenable alloy away from the other of said current-conducting members when said heat-softenable alloy softens sufficiently to free said other of said current-conducting members but continues to remain in holding engagement with said one of said current-conducting members.

2. An indicator-equipped, dual-element, electric fuse as claimed in claim 1 wherein said first said current-conducting member is adjacent one end of said casing, and wherein said second current-conducting member is displaced inwardly of the other end of said casing by said indicator.

3. An indicator-equipped, dual-element, electric fuse as claimed in claim 1 wherein a connector helps hold said heat-softenable alloy, and wherein said connector is trough-shaped.

4. An indicator-equipped, dual-element, electric fuse as claimed in claim 1 wherein a connector helps hold said heat-softenable alloy, and wherein one end of said first said current-conducting member extends only a short distance into said connector, and wherein one end of said second current-conducting member extends only a short distance into said connector.

5. An indicator-equipped, dual-element, electric fuse as claimed in claim 1 wherein said second current-conducting member is permanently secured to and will move with said indicator, and wherein said current-conducting members support, and fix the position of, said heat-softenable alloy.

6. An indicator-equipped, dual-element, electric fuse as claimed in claim 1 wherein a connector helps hold said heat-softenable alloy, wherein the first said current-conducting member acts in cantilever fashion to support and position one end of said connector, and wherein said indicator and said second current-conducting member coact in cantilever fashion to support and position the other end of said connector.

7. An indicator-equipped, dual-element, electric fuse as claimed in claim 1 wherein a connector helps hold said heat-softenable alloy, and wherein the maximum transverse linear dimension of said connector is less than the inner diameter of said casing to permit axial or radial movement of said connector relative to said casing.

8. An indicator-equipped, dual-element, electric fuse which comprises a casing, a current-conducting member disposed within said casing which will fuse if the temperature thereof is raised to the melting temperature thereof, a second current-conducting member disposed within said casing which will fuse if the temperature thereof is raised to the melting temperature thereof, said second current-conducting member having one end thereof adjacent one end of the first said current-conducting member, a connector adjacent said one ends of both of said current-conducting members, heat-softenable alloy which will soften if the temperature thereof is raised to the softening temperature thereof, said heat-softenable alloy normally holding said one ends of both of said current-conducting members in mechanical engagement and in electrically-conducting relation with said connector, an indicator which is disposable in an initial, retracted position or in a moved, extended position, said indicator being held in said initial, retracted position as long as both of said current-conducting members remain intact and said heat-softenable alloy holds said connector in mechanical engagement and electrically-conducting relation with said one ends of both of said current-conducting members, and a spring which moves said indicator to said moved, extended position and which simultaneously provides relative movement between said connector and at least one of said current-conducting members whenever said heat-softenable alloy softens or either of said current-conducting members fuses.

9. An indicator-equipped, dual-element, electric fuse as claimed in claim 8 wherein said connector is trough-shaped and is movable laterally away from both of said current-conducting members.

10. An indicator-equipped, dual-element, electric fuse as claimed in claim 8 wherein said current-conducting members extend generally axially of, and are displaced longitudinally of, said casing, and wherein said current-conducting members act in cantilever fashion to support and position said heat-softenable alloy.

11. An indicator-equipped, dual-element, electric fuse as claimed in claim 8 wherein said first said current-conducting member is adjacent one end of said casing, and wherein said second current-conducting member is displaced inwardly of the other end of said casing by said indicator.

12. An indicator-equipped, dual-element, electric fuse as claimed in claim 8 wherein said one end of said first said current-conducting member extends only a short distance into said connector, and wherein said one end of said second current-conducting member extends only a short distance into said connector.

13. An indicator-equipped, dual-element, electric fuse as claimed in claim 8 wherein said first said current-conducting member acts in cantilever fashion to support one end of said connector, and wherein said indicator and said second current-conducting member coact in cantilever fashion to support the other end of said connector.

14. An indicator-equipped, dual-element, electric fuse as claimed in claim 8 wherein the maximum transverse linear dimension of said connector is less than the inner diameter of said casing to permit axial or radial movement of said connector relative to said casing.

15. An indicator-equipped, dual-element, electric fuse which comprises a casing, a current-conducting member which is disposed within said casing and which will fuse if the temperature thereof is raised to the melting temperature thereof, a second current-conducting member which is disposed within said casing and which will fuse if the temperature thereof is raised to the melting temperature thereof, said second current-conducting member having one end thereof adjacent one end of the first said current-conducting member, heat-softenable alloy which has a melting temperature substantially lower than the melting temperature of either of said current-conducting members and which normally holds said one ends of said current-conducting members in mechanical engagement and in electrically-conducting relation, an indicator which is disposed in an initial retracted position or in a moved, extended position, said indicator being held in said initial, retracted position as long as both of said current-conducting members remain intact and said heat-softenable alloy remains in mechanical engagement and electrically-conducting relation with said one ends of both of said current-conducting members, and a spring which maintains both of said current-conducting members and said heat-softenable material under tension, said spring moving said indicator to said moved, extended position and simultaneously providing relative movement between said two current-conducting members and between one of said current-conducting members and said heat-softenable alloy whether said heat-softenable alloy softens or one or the other of said current-conducting members fuses.

* * * * *

UNITED STATES PATENT AND TRADEMARK OFFICE

CERTIFICATE OF CORRECTION

PATENT NO. : 4,058,784

DATED : November 15, 1977

INVENTOR(S) : Aldino J. Gaia

It is certified that error appears in the above-identified patent and that said Letters Patent are hereby corrected as shown below:

Column 7, lines 33 and 34, cancel "current-conduct" and substitute -current conducting- Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*